US010946677B2

(12) United States Patent
Loh et al.

(10) Patent No.: US 10,946,677 B2
(45) Date of Patent: Mar. 16, 2021

(54) PRINTER

(71) Applicant: TOSHIBA TEC KABUSHIKI KAISHA, Tokyo (JP)

(72) Inventors: YunReng Loh, Singapore (SG); InSeng Ooi, Singapore (SG); Kenji Eoka, Singapore (SG); Kiyotaka Nihashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 3 days.

(21) Appl. No.: 16/443,924

(22) Filed: Jun. 18, 2019

(65) Prior Publication Data

US 2019/0389233 A1 Dec. 26, 2019

(30) Foreign Application Priority Data

Jun. 26, 2018 (JP) ..... JP2018-121178

(51) Int. Cl.
*B41J 13/02* (2006.01)

(52) U.S. Cl.
CPC ..... *B41J 13/02* (2013.01)

(58) Field of Classification Search
CPC . B41J 13/02; B41J 15/042; B41J 29/13; B41J 29/02; B41J 13/00; B41J 13/0009; B41J 15/00; B41J 15/04; B41J 15/044; B41J 15/046
See application file for complete search history.

(56) References Cited

U.S. PATENT DOCUMENTS 5,820,068 A * 10/1998 Hosomi ..... B26D 7/24 242/563
7,404,683 B2 6/2008 Mochizuki et al.

FOREIGN PATENT DOCUMENTS

JP 2909302 6/1999

* cited by examiner

*Primary Examiner* — Kristal Feggins
(74) *Attorney, Agent, or Firm* — Amin, Turocy & Watson, LLP

(57) ABSTRACT

A printer comprises a printer casing accommodating a rolled paper and including an opening through which the roll paper is loaded; a roll-paper holder, arranged on one of the ends side of the printer casing and including a holding member formed in an arc shape; a cover including a lid opened or closed by a hinge mechanism pivotally supported on the one of the ends side of the opening to open or close the opening, and a roll-cover, integrally formed with the lid, which has an arc shape in cross section to move along an outer surface of the roll-paper holder; a paper conveyance mechanism, arranged in the printer casing, configured to pull out and convey a leading end paper from the rolled paper; and a printing mechanism, arranged in the printer casing, configured to perform printing on the paper conveyed by the paper conveyance mechanism.

20 Claims, 5 Drawing Sheets

PRINTER

CROSS-REFERENCE TO RELATED APPLICATION

This application is based upon and claims the benefit of priority from Japanese Patent Application No. 2018-121178, filed on Jun. 26, 2018, the entire contents of which are incorporated herein by reference.

FIELD

Embodiments described herein relate generally to a printer.

BACKGROUND

In a well-known printer, a rolled paper is used as a print medium. The rolled paper is housed in a housing of the printer and a leading end thereof is pulled out to be printed. Such a printer includes an opening capable of continuously connecting an inner space with an outer space of the housing. The opening has a size larger than that (width and diameter) of the rolled paper to be housed, and is covered by an openable cover. The cover is supported at the housing by a shaft substantially parallel to an axis of the rolled paper housed in the housing through the opening. A conveyance mechanism for conveying a paper pulled out of the rolled paper and a printing mechanism are also housed in the housing. At the time of printing, the printer draws out the paper from the rolled paper, performs printing thereon, cuts the printed paper, and finally issues the printed paper as a receipt, for example.

In such a printer, if the opening through which the rolled paper is loaded is intended to be widened, the cover that covers the opening is also enlarged accordingly. However if the cover is enlarged, further durability is required also for a mechanism that supports the cover in an openable manner, which leads to large size of the printer, and thus, a relatively large space is needed to install such printer.

Therefore, there is a demand for a device capable of widening the opening through which the rolled paper is loaded and capable of narrowing a space required for installation.

DETAILED DESCRIPTION

In accordance with an embodiment, a printer comprises a printer casing configured to rotatably accommodate a rolled paper, the printer casing including an opening through which the rolled paper is loaded and a bottom oppositely arranged against the opening; a roll-paper holder, arranged on one of the ends side of the printer casing to have an inner space communicating with the opening, configured to rotatably support the bottom side of the rolled paper, the roll-paper holder including a holding member formed in an arc shape having an angular range at least from the bottom side to a position along an opening surface of the opening; a cover including a lid opened or closed by a hinge mechanism pivotally supported on the one of the ends side of the opening to open or close the opening, and a roll-cover, integrally formed with the lid, which has an arc shape in cross section to move along an outer surface of the roll-paper holder; a paper conveyance mechanism, arranged in the printer casing, configured to pull out and convey a leading end paper from the rolled paper; and a printing mechanism, arranged in the printer casing, configured to perform printing on the paper conveyed by the paper conveyance mechanism.

Hereinafter, the present embodiment is described with reference to the accompanying drawings.

FIG. 1 to FIG. 5 show a printer 10 according to the present embodiment. An arrow F in each drawing indicates a front surface direction of the printer 10 and also indicates a side where an operator is normally present. An arrow B indicates a back surface direction. Furthermore, an arrow WL indicates a left direction, an arrow WR indicates a right direction, and an arrow V indicates a vertically upward direction. In these drawings, a reference symbol R indicates a rolled paper and a reference symbol P indicates a printing paper pulled out from the rolled paper. The printer 10 is installed in the vicinity of, for example, a POS (Point Of Sales) terminal, an ECR (electronic cash register) or the like in a retail store or the like. Then, predetermined printing is performed on the paper P pulled out from the rolled paper R, and a receipt, a coupon, a ticket, or the like is issued.

Figure 1:
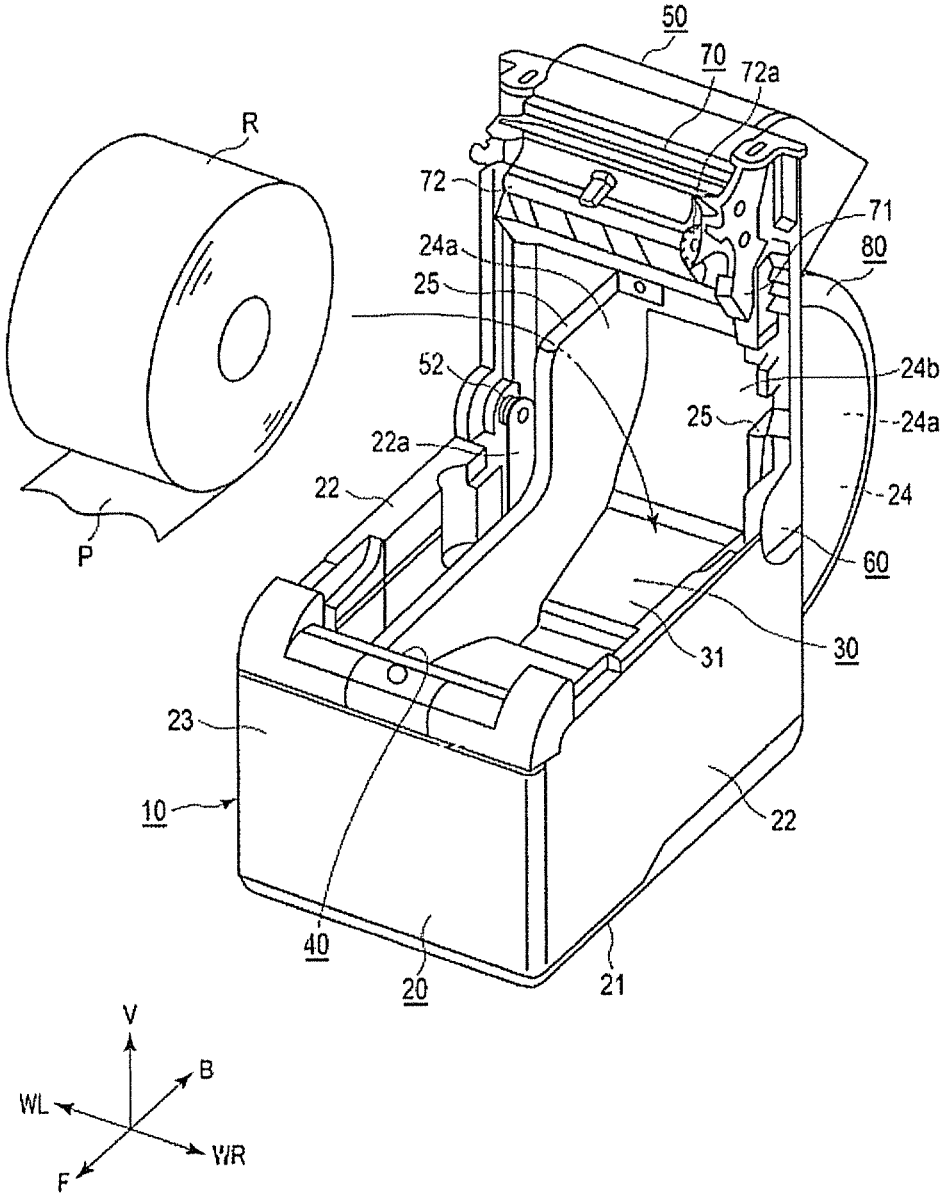
FIG. 1 is a perspective view schematically illustrating a configuration of a printer according to an embodiment.

As shown in FIG. 1, the printer 10 includes a rectangular parallelepiped-shape printer casing 20 of which an upper portion is opened, and a top cover 50 attached to the printer casing 20 in an openable manner. The opening is formed substantially in a horizontal plane. The opening is large enough to receive a rolled paper R having the maximum diameter that can be accommodated. Specifically, the inner dimension in a left-right direction along the directions indicated by the arrow WL and the arrow WR of the opening is set to be larger than the dimension in a width direction of the printing paper P. The inner dimension in a front-back direction along the directions indicated by the arrow F and the arrow B of the opening is set to be larger than the diameter of the rolled paper R. Therefore, the rolled paper can pass through the opening even if the rolled paper is loaded into the opening somewhat carelessly.

As shown in FIG. 1, the printer casing 20 includes a bottom plate 21, a pair of side plates 22 provided on the left and right sides of the bottom plate 21, and a front plate 23 provided on the front side of the bottom plate 21. Further, on the rear side of the bottom plate 21, a roll-paper holder 24, which is formed in a quarter round shape, projecting further backward from the rear side is provided.

Figure 5:
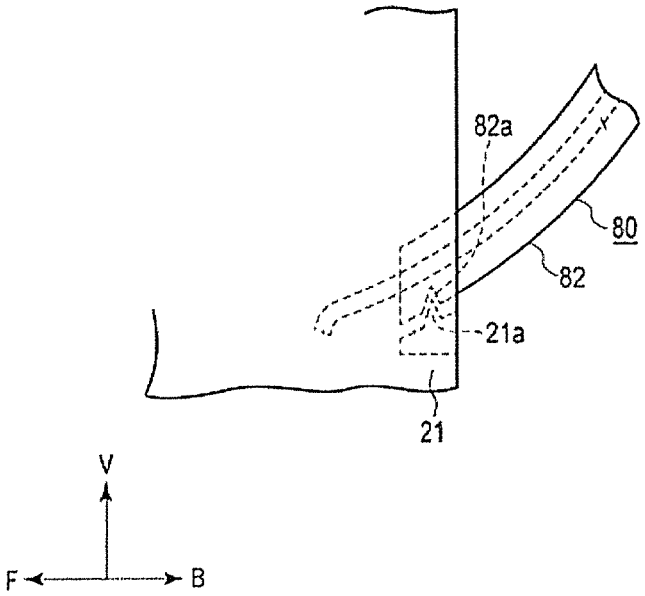
FIG. 5 is a diagram illustrating a latch mechanism of the printer shown in FIG. 1.

As shown in FIG. 5, a wedge-shaped locking portion 21*a* protruding upward by about 1 mm is formed on the bottom plate 21. The locking portion 21*a* is engaged with a concave portion (engagement portion) 82*a* having a depth of about 1 mm and provided at a lower end of a curved plate portion 82 of a roll-cover member 80 described later. A latch mechanism is composed of the locking portion 21*a* and the concave portion 82*a*.

The roll-paper holder 24 is composed of right and left rear plate portions 24*a* each having a fan shape of a substantially quarter round formed on the back side of each side plate 22, and curved plate portions (holding member) 24*b* for connecting arc-like peripheral edges of these rear plate portions 24*a*. A center of the fan-shaped plate forming the rear plate portion 24*a* substantially coincides with a rotation shaft of a hinge mechanism 60 described later. The rear plate portion 24*a* is formed over an angular range from the bottom plate 21 side to a position along the opening, i.e., to the horizontal plane. The curved plate portion 24*b* has an arc shape in cross section in a vertical direction, and is formed over an angular range from the bottom plate 21 side to a position along the opening, i.e., to the horizontal plane. The lower side of the rolled paper R is held on the inner surface of the curved plate portion 24*b*.

The inner diameter of the roll-paper holder 24 is larger than the maximum diameter of the rolled paper R. A space in a substantially rectangular parallelepiped shape surrounded by the bottom plate 21, the pair of side plates 22 and the front plate 23 communicates with the internal space of the roll-paper holder 24. Further, the internal space of the roll-paper holder 24 also communicates with the opening of the printer casing 20. The roll-paper holder 24 holds the lower side and the rear side of the rolled paper R loaded therein.

The roll-paper holder 24 described above can accommodate the half-round portion of the rolled paper R in the opening even for the rolled paper R having the maximum diameter that can be accommodated. Therefore, even if the rolled paper R having the maximum diameter that can be accommodated is loaded somewhat roughly and carelessly and is overly moved on the roll-paper holder 24, the rolled paper R never comes out of the opening.

Rod-like friction members (sliding members) 25 are provided on outer sides of the left and right rear plate portions 24*a*. The friction members 25 are arranged at a position and dimension that enables the friction members 25 to slidably contact inner walls of a pair of left and right side plates 81 of a roll-cover member 80 described later.

The rolled paper R is rotated as the printing paper P (leading end thereof) is pulled out forward. An inner surface of the curved plate portion 24*b* is smoothly formed so that the rolled paper R is smoothly rotated.

As shown in FIG. 1, the rolled paper R is loaded from the opening of the printer casing 20 with a central axis of the rolled paper R set as the left-right direction of the printer casing 20 in a state in which the printing paper P is pulled out forward from the lower side to be loaded in the roll-paper holder 24. The central axis of the rolled paper R is not pivotally supported with respect to the printer casing 20, and as the printing paper P is pulled out, a radius of the rolled paper R becomes smaller and thus the central axis thereof moves downward.

A paper conveyance mechanism 30 for pulling out and conveying the printing paper P from the rolled paper R, a printing mechanism 40, arranged on the front surface side of the printer casing 20, for performing printing on the paper conveyed by the paper conveyance mechanism 30, and a controller 100 that controls each section and mechanism are provided in the printer casing 20. The printing mechanism 40 is positioned on the downstream side in a conveyance direction of the printing paper P with respect to the paper conveyance mechanism 30.

A guide plate 31 for guiding the printing paper P to the printing mechanism 40 is provided in the paper conveyance mechanism 30. The guide plate 31 forms a paper conveyance path through which the printing paper P is conveyed.

The printing mechanism 40 includes a paper feed mechanism 41 which continuously or intermittently feeds the printing paper P conveyed by the paper conveyance mechanism 30, and a print head 42 energized according to a printing signal transmitted from the controller 100 in a state in which the printing paper P is sandwiched by the print head 42 and a platen roller 72. The paper feed mechanism 41 includes a motor 41*a* and a drive gear 41*b*, connected to an output shaft of the motor 41*a*, to which the rotational motion is transmitted through the output shaft.

The controller 100 is provided below the paper conveyance mechanism 30 and the printing mechanism 40 described above. The controller 100 transmits a predetermined paper feed signal and a printing signal to the paper conveyance mechanism 30 and the printing mechanism 40.

The top cover 50 includes a square frame-shaped cover main body 51 for covering the opening of the printer casing 20. The cover main body 51 is rotatably attached to the hinge mechanism 60 provided at end portions of the side plates of the printer casing 20. The cover main body 51 includes a movable mechanism 70 positioned on the front side and a substantially half-round roll cover member 80 positioned on the rear side thereof.

Figure 2:
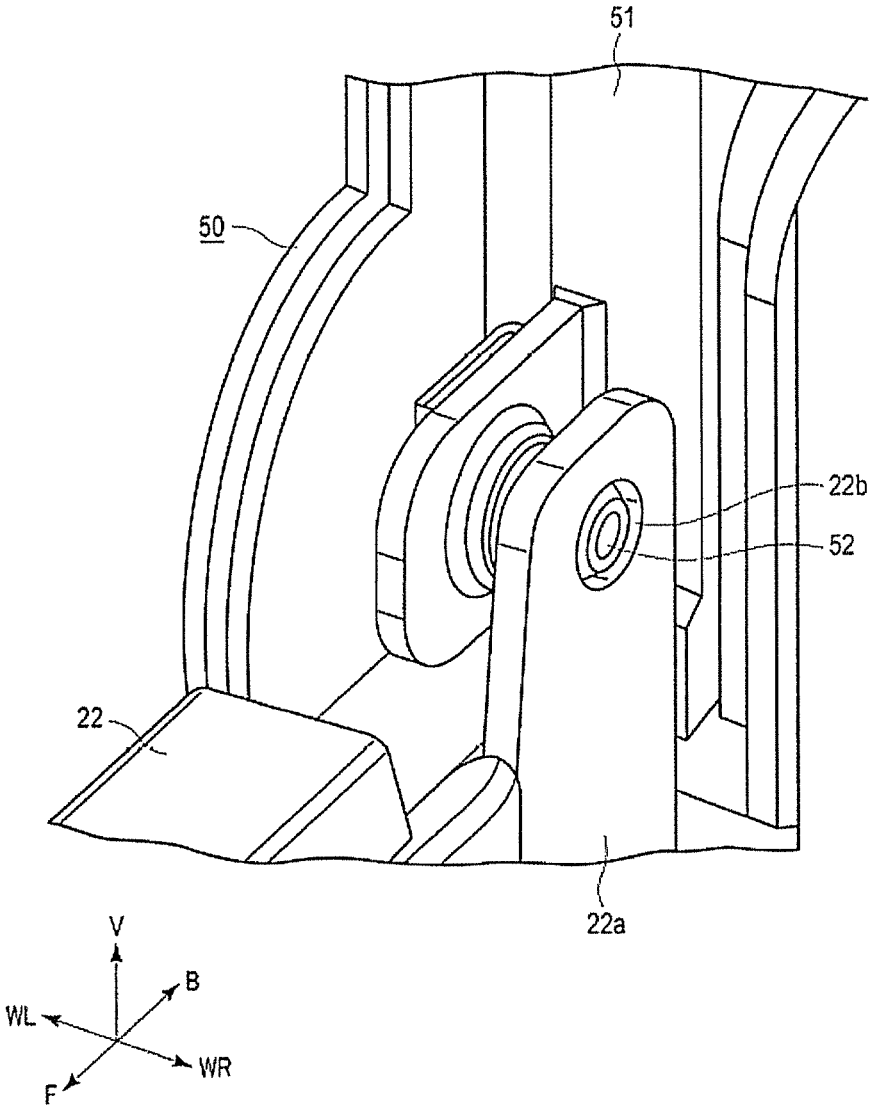
FIG. 2 is a perspective view illustrating a hinge mechanism of the printer shown in FIG. 1.

As shown in FIG. 2, the hinge mechanism 60 is formed by inserting a rotation shaft 52 provided on the cover main body 51 into an opening hole 22*b* provided in an erected piece member 22*a* arranged on the side plate 22 of the printer casing 20. The erected piece 22*a* can be bent towards the inside of the printer casing 20. Therefore, if attaching or detaching the cover main body 51 to or from the printer casing 20 at the time of maintenance, the rotation shaft 52 can be easily attached or detached by bending the erected piece member 22*a* in the directions indicated by the arrow WL and the arrow WR by a user. The axis of the rotation shaft 52 is parallel to the axis (center) of the rolled paper when the rolled paper having the maximum diameter that can be accommodated is loaded, and axial directions of the both are substantially the same.

Figure 3:
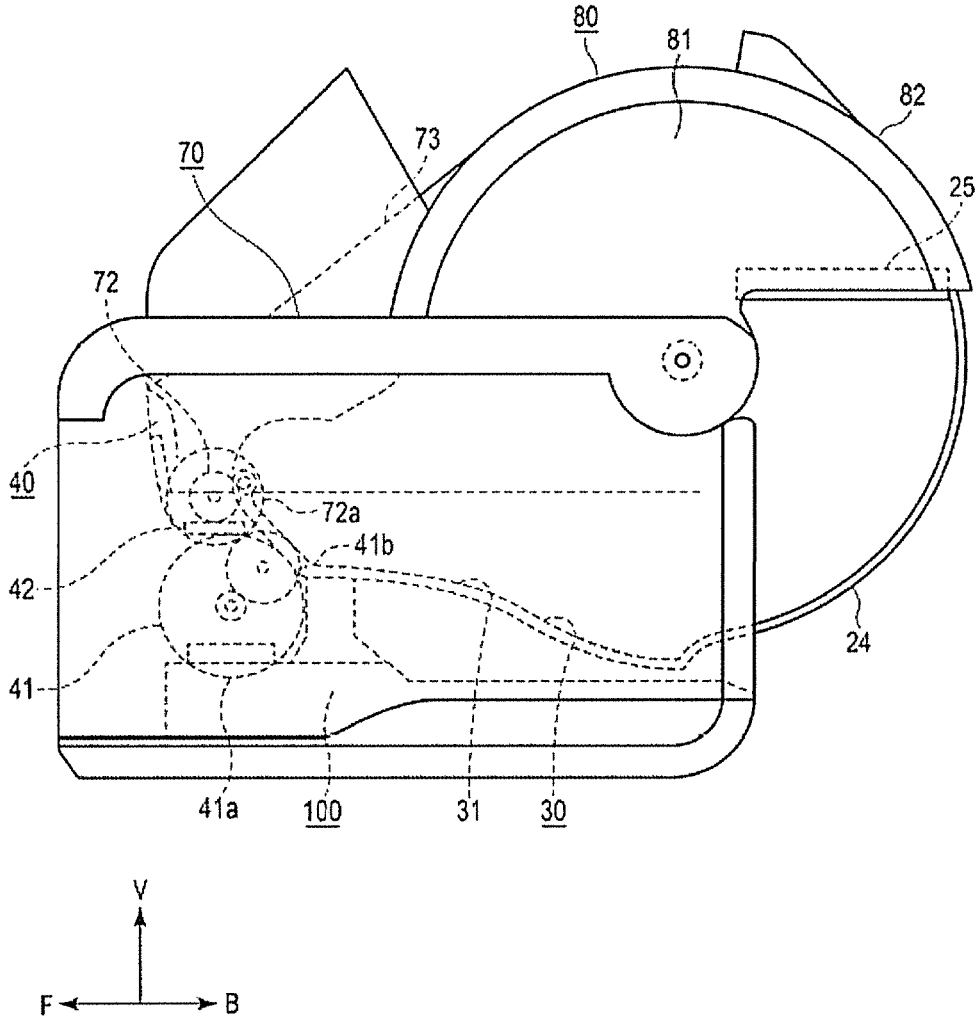
FIG. 3 is a side view illustrating a closed state of a top cover of the printer shown in FIG. 1.
Figure 4:
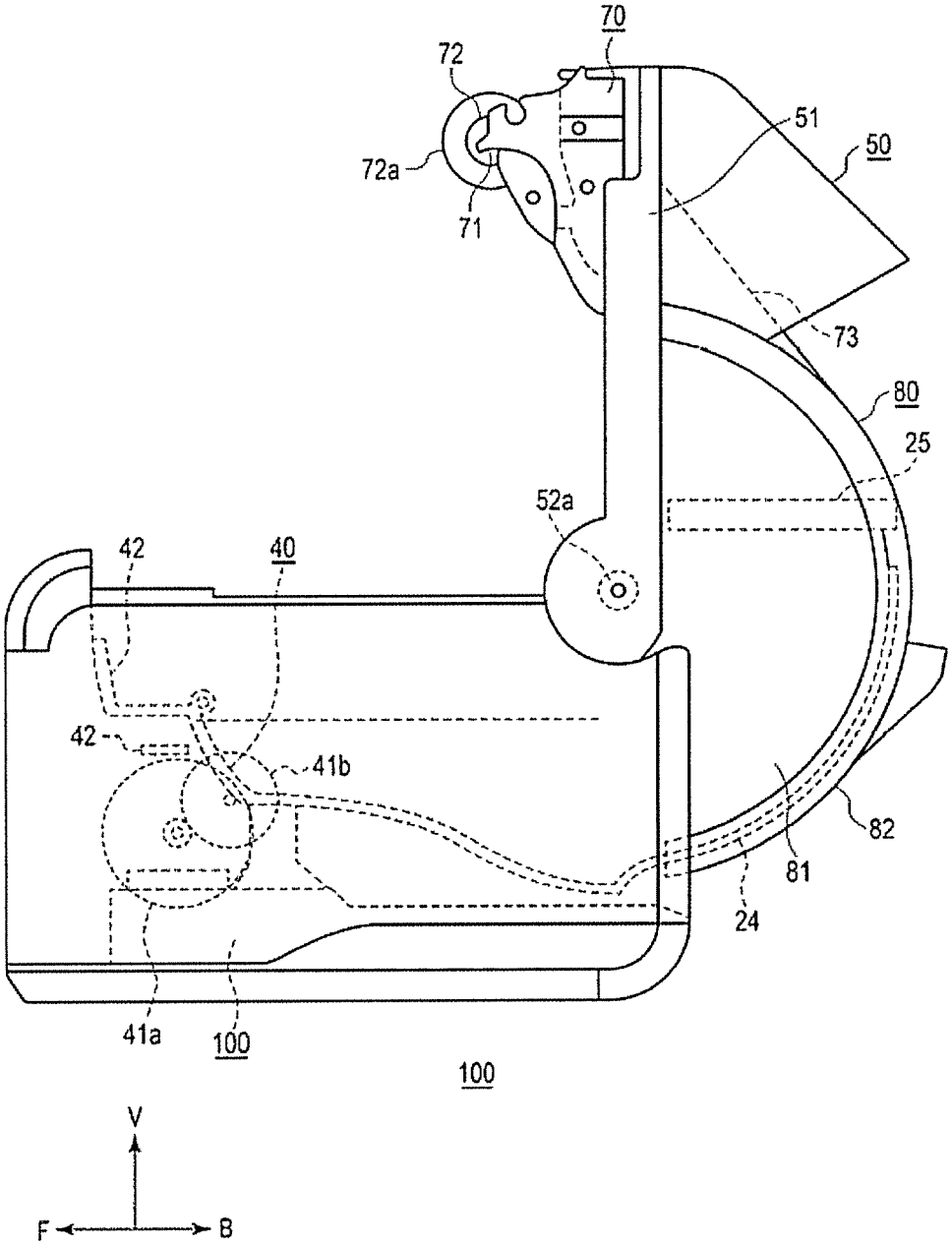
FIG. 4 is a side view illustrating an opened state of the top cover of the printer.

The range of rotation of the cover main body 51 via the hinge mechanism 60 is set from a position where the cover main body 51 is substantially horizontal and overlaps with the opening of the printer casing 20, as shown in FIG. 3, to a position where the cover main body 51 is substantially vertical and becomes upright with respect to the opening of the printer casing 20, as shown in FIG. 4.

In the open state of the cover main body 51, a linear distance between the platen roller 72 and the print head 42 is larger than the maximum diameter of the rolled paper to be accommodated. Therefore, the rolled paper can be easily loaded from the obliquely upper side of the printer towards the opening. Even if the rolled paper is roughly loaded to a certain extent, the rolled paper hits the cover main body 51 at an upright position and is bounced back, and then falls into the roll-paper holder 24.

Furthermore, in the open state of the cover main body 51, the center of gravity of the cover main body 51 is positioned slightly close to the back surface side from the upper side of the hinge mechanism 60. The center of gravity of the cover main body 51 is set by design. For example, since the platen roller 72 of which the weight is relatively heavy is positioned at the front side of the cover main body 51, the position of the center of gravity of the cover main body 51 is set by, for example, making other components close to the back side.

The movable mechanism 70 includes an opening/closing engagement portion 71 detachably engaged with the printer casing 20 in the closed state of the cover main body 51, the platen roller 72, having a horizontal rotation shaft, which faces the above-described print head 42 and the guide 73 for guiding the printing paper P already printed to the upper surface side of the cover main body 51.

If the cover main body 51 is pivoted to a horizontal position, the opening/closing engagement portion 71 is engaged with the printer casing 20 to maintain the closed state of the cover main body 51.

As shown in FIG. 3 and FIG. 4, a driven gear 72*a* is coaxially fixed to the shaft of the platen roller 72. When the cover main body 51 is closed, the platen roller 72 enters the inside of the printer casing 20 and is located at a position facing the print head 42. At this time, the driven gear 72*a* meshes with the driving gear 41*b*. The position where the platen roller 72 faces the print head 42 is closer to the opening side compared with a position where the peripheral surface of the loaded rolled paper R contacts the guide plate 31, and is below the position of the rotation shaft 52 of the hinge mechanism 60.

The roll-cover member 80 includes a pair of right and left side plates 81 each having a substantially half-round fan shape and integrally connected to the back surface side of the cover main body 51, and a curved plate portion 82 for connecting the arc-like peripheral edges of these side plates 81. An inner diameter of the curved plate portion 82 of the roll-cover member 80 is larger than an outer diameter of the curved plate portion 24*b* of the roll-paper holder 24 described above. Accordingly, the roll-cover member 80 coaxially rotates at the outside of the roll-paper holder 24 as the top cover 50 is opened and closed.

The roll-cover member 80 and the roll-paper holder 24 overlap each other over a narrow angular range in the closed state of the cover main body 51 and overlap in the range of about 90° in the open state of the cover main body 51. The roll-cover member 80 is located at a position covering the upper side of the rolled paper R loaded in the printer casing 20 and the roll-paper holder 24.

The rolled paper R is loaded in the printer 10 constituted as described above in the following manner. First, as shown in FIG. 1, the top cover 50 is opened. At the time of opening the top cover 50, the friction member 25 contacts the inner surface of the side plate 81 in a slidable manner, and a user opens the top cover 50 while feeling a slight resistance on his/her hand. If the top cover 50 is opened to a position at which the movable mechanism 70 is located just above the hinge mechanism 60, the locking portion 21*a* and the concave portion 82*a* are engaged with each other, and thus the movable mechanism 70 of the top cover 50 is stopped at the position directly above the hinge mechanism 60. At this time, the user receives a slight click feeling on his/her finger and recognizes the stop position. In this state, since the center of gravity of the top cover 50 is located on the back surface side, the top cover 50 is not reversely rotated to the front surface side due to its own weight. Further, since the engagement between the locking portion 21*a* and the concave portion 82*a* is not released due to just the weight of the top cover 50, the top cover 50 is not inadvertently closed from this position.

Furthermore, even in the open state of the top cover 50, since the roll-cover member 80 is opened along the roll-paper holder 24, the other portion of the top cover 50 does not protrude to the back surface side, and thus a superfluous space on the back side is not required.

As shown in FIG. 1, the rolled paper R is loaded in a state in which the printing paper P (leading end of the rolled paper R) positions at a near side in the direction indicated by the arrow F. Next, the end of the printing paper P is pulled out along the guide plate 31 to be extended to the position of the print head 42 of the printing mechanism 40. Then, the top cover 50 is closed. At the beginning of closing the top cover 50, the user releases the engagement between the locking portion 21*a* and the concave portion 82*a*, and thus, the user receives a slight click feeling on his/her finger. Furthermore, as the top cover 50 is closed, the friction member 25 contacts the inner surface of the side plate 81 in a slidable manner, and the user feels a slight resistance on his/her hand. Even if the user intends to close the top cover 50 swiftly, the movable mechanism 70 and the printing mechanism 40 do not collide with one the other due to the sliding resistance between the friction member 25 and the inner surface of the side plate 81.

When the top cover 50 is rotated to the horizontal position, the opening/closing engagement portion 71 of the top cover 50 is engaged with the printer casing 20, and the cover main body 51 is closed. When the cover main body 51 is closed, the platen roller 72 and the print head 42 face each other, and the print head 42 is elastically pressed against the platen roller 72 due to the elasticity of an elastic member (not shown).

When the power supply of the printer 10 is turned on in a state in which the top cover 50 is completely closed as described above, the feed motor 41*a* is activated and the platen roller 72 rotates in the conveying direction via the drive gear 41*b*. The printing paper P sandwiched between the print head 42 of the printing mechanism 40 and the platen roller 72 is fed out by the rotation of the platen roller 72 and enters a standby state. In response to the reception signal received from the outside device, the controller 100 outputs a print signal, activates the paper feed mechanism 41, the print head 42, and the platen roller 72 to start a desired printing operation. With the progress of the printing operation, the printing paper P is cut and placed on the cover main body 51 as necessary.

In such a printer 10 described above, the position of the hinge mechanism 60 of the top cover 50 opened at the time of replacing or replenishing the rolled paper R is set to be close to the back surface side of the printer casing 20, and the roll-cover member 80 of the top cover 50 does not protrude towards the back surface side by being rotated along the roll-paper holder 24. In this way, the opening and closing range of the top cover 50 can be limited and thus the printer 10 can be easily installed in a place having a relatively small area in depth. Further, the center of gravity of the top cover 50 is set to a position opposite to the printing mechanism 40 with respect to the hinge mechanism. 60 when the top cover 50 is fully opened. Thus, the top cover 50 is not inadvertently closed, and the usability of the printer 10 can be enhanced. When the top cover 50 is fully opened, the concave portion 82*a* is engaged with the locking portion 21*a* provided in the printer casing 20. The user can recognize a fully open position of the top cover 50 and moreover, closing the top cover 50 by its own weight can be prevented.

Furthermore, the friction member 25, which contacts the inner surface of the side plate 81 of the top cover 50 in a slidable manner at the time of opening and closing the top cover 50, is provided on the outer surface of the roll-paper holder 24. Closing the top cover 50 at unnatural speed can be prevented and thus strong contact between the members can be avoided, previously.

The above-described roll-paper holder does not pivotally support the rolled paper, but it may arrange a pivot support member, protruding toward inside of the printer casing, to pivotally support the rolled paper. The latch mechanism may be provided at any positions as long as it is set to a position where the top cover can be engaged with respect to the printer casing. Besides the roll-paper holder and the roll-cover member, the friction member (sliding member) may be positioned any other position as long as it is set to a position where a frictional force is applied at the time of opening and closing the top cover. Furthermore, the position where the opening and the cover are provided is not limited to the upper part of the printer casing, but the opening and the cover may be provided on a side surface thereof.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a printer casing configured to rotatably accommodate a rolled paper, the printer casing including an opening through which the rolled paper is loaded and a bottom oppositely arranged with respect to the opening;

a roll-paper holder, arranged on one of the end sides of the printer casing to have an inner space communicating with the opening, configured to rotatably support the bottom side of the rolled paper, the roll-paper holder including a holding member formed in an arc shape having an angular range at least from the bottom side to a position along an opening surface of the opening;

a cover including a lid opened or closed by a hinge mechanism pivotally supported on the one of the end sides of the opening to open or close the opening, and a roll-cover, integrally formed with the lid, which has an arc shape in cross section to move along an outer surface of the roll-paper holder, wherein:

the roll-cover comprises a pair of arc shaped side plates and a curved plate portion connected to each arc shaped side plate of the pair of arc shaped side plates at a peripheral edge of each arc shaped side plate of the pair of arc shaped side plates, each arc shaped side plate of the pair of arc shaped side plates is connected to the cover, an inner diameter of the curved plate portion of the roll-cover is larger than an outer diameter of a curved plate portion of the roll-paper holder, and the roll-cover coaxially rotates about the outer surface of the roll-paper holder;

a paper conveyance mechanism, arranged in the printer casing, configured to pull out and convey a leading end paper from the rolled paper; and a printing mechanism, arranged in the printer casing, configured to perform printing on a portion of the rolled paper conveyed by the paper conveyance mechanism.

2. The printer according to claim 1, wherein the cover has an engagement portion that engages with a locking portion provided in the printer casing when the cover is fully opened.

3. The printer according to claim 1, further including a sliding member, provided on the outer surface of the roll-paper holder, configured to contact an inner surface of the cover in a slidable manner when the cover is opened or closed.

4. The printer according to claim 1, wherein the opening is formed on an upper surface of the printer casing, and the cover has a front end which stops at a position above the hinge mechanism when the cover is fully opened.

5. The printer according to claim 2, wherein the cover has a center of gravity positioned on the roll-paper holder side with respect to the hinge mechanism when the cover is fully opened.

6. The printer according to claim 1, wherein the opening has a length greater than a width of the rolled paper.

7. The printer according to claim 1, wherein the roll-paper holder projects backwards within the printer casing.

8. The printer according to claim 1, wherein an inner diameter of the roll-paper holder is greater than a maximum diameter of the rolled paper.

9. The printer according to claim 1, wherein the cover has an opening/closing engagement portion, and when the cover is rotated to a horizontal position, the opening/closing engagement portion engages with the printer casing so as to be in a closed state.

10. The printer according to claim 9, wherein in the closed state, a platen roller and a print head of the printing mechanism face each other, and the print head is elastically pressed against the platen roller.

11. A thermal printer, comprising:

a printer casing configured to rotatably accommodate a rolled paper, the printer casing including an opening through which the rolled paper is loaded and a bottom oppositely arranged with respect to the opening;

a roll-paper holder, arranged on one of the end sides of the printer casing to have an inner space communicating with the opening, configured to rotatably support the bottom side of the rolled paper, the roll-paper holder including a holding member formed in an arc shape having an angular range at least from the bottom side to a position along an opening surface of the opening;

a cover including a lid opened or closed by a hinge mechanism pivotally supported on the one of the end sides of the opening to open or close the opening, and a roll-cover, integrally formed with the lid, which has an arc shape in cross section to move along an outer surface of the roll-paper holder, wherein:

the roll-cover comprises a pair of arc shaped side plates and a curved plate portion connected to each arc shaped side plate of the pair of arc shaped side plates at a peripheral edge of each arc shaped side plate of the pair of arc shaped side plates, each arc shaped side plate of the pair of arc shaped side plates is connected to the cover, an inner diameter of the curved plate portion of the roll-cover is larger than an outer diameter of a curved plate portion of the roll-paper holder, and the roll-cover coaxially rotates about the outer surface of the roll-paper holder;

a paper conveyance mechanism, arranged in the printer casing, configured to pull out and convey a leading end paper from the rolled paper; and a thermal printing mechanism, arranged in the printer casing, configured to perform thermal printing on a portion of the rolled paper conveyed by the paper conveyance mechanism.

12. The thermal printer according to claim 11, wherein the cover has an engagement portion that engages with a locking portion provided in the printer casing when the cover is fully opened.

13. The thermal printer according to claim 11, further including a sliding member, provided on the outer surface of the roll-paper holder, configured to contact an inner surface of the cover in a slidable manner when the cover is opened or closed.

14. The thermal printer according to claim 11, wherein the opening is formed on an upper surface of the printer casing, and the cover has a front end which stops at a position above the hinge mechanism when the cover is fully opened.

15. The thermal printer according to claim 12, wherein the cover has a center of gravity positioned on the roll-paper holder side with respect to the hinge mechanism when the cover is fully opened.

16. The thermal printer according to claim 11, wherein the opening has a length greater than a width of the rolled paper.

17. The thermal printer according to claim 11, wherein the roll-paper holder projects backwards within the printer casing.

18. The thermal printer according to claim 11, wherein an inner diameter of the roll-paper holder is greater than a maximum diameter of the rolled paper.

19. The thermal printer according to claim 11, wherein the cover has an opening/closing engagement portion, and when the cover is rotated to a horizontal position, the opening/closing engagement portion engages with the printer casing so as to be in a closed state.

20. The thermal printer according to claim 19, wherein in the closed state, a platen roller and a thermal print head of the printing mechanism face each other, and the thermal print head is elastically pressed against the platen roller.

* * * * *